US008841862B2

(12) United States Patent
Lee

(10) Patent No.: US 8,841,862 B2
(45) Date of Patent: Sep. 23, 2014

(54) LED DRIVING SYSTEM AND METHOD FOR VARIABLE VOLTAGE INPUT

(76) Inventor: Chong Uk Lee, San Diego, CA (US)

( * ) Notice: Subject to any disclaimer, the term of this patent is extended or adjusted under 35 U.S.C. 154(b) by 120 days.

(21) Appl. No.: 13/527,787

(22) Filed: Jun. 20, 2012

(65) Prior Publication Data

US 2013/0002141 A1 Jan. 3, 2013

Related U.S. Application Data

(60) Provisional application No. 61/502,380, filed on Jun. 29, 2011.

(51) Int. Cl.
*H05B 37/02* (2006.01)
*H05B 33/08* (2006.01)

(52) U.S. Cl.
CPC ..... *H05B 33/083* (2013.01)
USPC ..... 315/306; 315/185 R; 315/307

(58) Field of Classification Search
USPC ..... 315/185 R, 291, 294, 297, 306–308
See application file for complete search history.

(56) References Cited

U.S. PATENT DOCUMENTS

| | | | | |
|---|---|---|---|---|
| 5,301,098 | A | 4/1994 | Dhyanchand et al. | |
| 5,896,084 | A | 4/1999 | Weiss et al. | |
| 6,756,893 | B1 | 6/2004 | Fernandez | |
| 6,836,157 | B2 | 12/2004 | Rader et al. | |
| 6,989,807 | B2 | 1/2006 | Chiang | |
| 7,081,722 | B1 | 7/2006 | Huynh et al. | |
| 7,138,770 | B2 | 11/2006 | Uang et al. | |
| 7,439,944 | B2 | 10/2008 | Huynh et al. | |
| 7,521,879 | B2 | 4/2009 | Hong et al. | |
| 7,685,753 | B2 | 3/2010 | Slowski | |
| 7,919,936 | B2 | 4/2011 | Liu et al. | |
| 7,936,135 | B2 | 5/2011 | Hum et al. | |
| 7,940,014 | B2 | 5/2011 | Shin et al. | |
| 7,977,891 | B2 | 7/2011 | Shiu et al. | |
| 7,986,107 | B2 * | 7/2011 | Weaver et al. | 315/291 |
| 7,994,725 | B2 | 8/2011 | Bouchard | |
| 8,289,263 | B2 | 10/2012 | Lee et al. | |
| 8,508,140 | B2 * | 8/2013 | Leung et al. | 315/192 |
| 8,598,805 | B2 * | 12/2013 | Tremblay et al. | 315/291 |
| 2003/0164809 | A1 | 9/2003 | Leung | |
| 2006/0175985 | A1 | 8/2006 | Huynh et al. | |
| 2006/0208669 | A1 | 9/2006 | Huynh et al. | |
| 2007/0091598 | A1 | 4/2007 | Chen | |

(Continued)

FOREIGN PATENT DOCUMENTS

| | | |
|---|---|---|
| JP | 2007123562 | 5/2007 |
| JP | 2007173813 | 7/2007 |

(Continued)

*Primary Examiner* — Tung X Le
(74) *Attorney, Agent, or Firm* — Lipsitz & McAllister, LLC

(57) ABSTRACT

A plurality of light emitting diodes (LEDs) is driven based on the voltage and current requirements of the LEDs at any given time. The driving of the LEDs is adapted to the input voltage provided. A series of switches (e.g. MOSFETS) is used to selectively illuminate the LEDs according to the input voltage and current, with more LEDs being lit as the input voltage or current increases. In one configuration, the switches are driven to provide a light dimming function. The LEDs can be controlled remotely using, e.g. an X10 communication protocol. A direct current implementation is also provided. In an alternate embodiment, the LEDs are used in photo diode mode for communication with a remote controller or other light bulbs.

20 Claims, 7 Drawing Sheets

(56) References Cited

U.S. PATENT DOCUMENTS

| | | | |
|---|---|---|---|
| 2007/0145914 | A1 | 6/2007 | Hong et al. |
| 2007/0252005 | A1 | 11/2007 | Konicek |
| 2007/0257623 | A1 | 11/2007 | Johnson et al. |
| 2008/0088571 | A1 | 4/2008 | Lee et al. |
| 2008/0116817 | A1 | 5/2008 | Chao et al. |
| 2009/0128055 | A1 | 5/2009 | Shin et al. |
| 2009/0315480 | A1 | 12/2009 | Yan et al. |
| 2009/0315481 | A1 | 12/2009 | Zhao |
| 2010/0072898 | A1 | 3/2010 | Ohashi et al. |
| 2010/0134018 | A1 | 6/2010 | Tziony et al. |
| 2010/0134038 | A1 | 6/2010 | Shackle et al. |
| 2010/0194274 | A1 | 8/2010 | Hoogzaad |
| 2010/0194298 | A1 | 8/2010 | Kuwabara |
| 2010/0295478 | A1 | 11/2010 | Wei et al. |
| 2010/0308738 | A1 | 12/2010 | Shteynberg et al. |
| 2010/0308739 | A1* | 12/2010 | Shteynberg et al. ..... 315/193 |
| 2011/0068700 | A1 | 3/2011 | Fan |
| 2011/0140622 | A1 | 6/2011 | Suzuki |
| 2011/0273102 | A1 | 11/2011 | van de Ven et al. |
| 2011/0273103 | A1 | 11/2011 | Hong |
| 2012/0081009 | A1 | 4/2012 | Shteynberg et al. |
| 2012/0229030 | A1 | 9/2012 | Moskowitz et al. |
| 2012/0280622 | A1 | 11/2012 | Jeong et al. |

FOREIGN PATENT DOCUMENTS

| | | |
|---|---|---|
| JP | 2010225742 | 10/2010 |
| KR | 20080034316 | 4/2008 |
| KR | 20090050381 | 5/2009 |
| KR | 100905844 | 7/2009 |
| KR | 20100067468 | 6/2010 |
| KR | 100973014 | 7/2010 |
| KR | 100997050 | 11/2010 |
| WO | 2012034102 | 3/2012 |
| WO | 2012061999 | 5/2012 |

* cited by examiner

LED DRIVING SYSTEM AND METHOD FOR VARIABLE VOLTAGE INPUT

This application claims priority of commonly owned, U.S. Provisional Patent Application No. 61/502,380 filed on Jun. 29, 2011, the entire contents of which is incorporated herein by reference.

BACKGROUND OF THE INVENTION

The present invention relates to the field of Light Emitting Diode (LED) driving systems and LED driving methods for lighting LEDs.

More specifically, the present invention relates to driving LEDs in lighting applications. Currently, LED driver circuits are complex and often include feedback circuits to keep the current through an LED constant. For example, U.S. Pat. No. 6,836,157 issued to Rader et al., teaches a plurality of LEDs driven in parallel, in at least two modes. In a first mode, the LEDs are driven with a first voltage. In subsequent modes, the LEDs are driven with successively higher voltages. The forward voltage drop for each LED is monitored, and the driver switches from the first mode to successive modes based on the largest of the LED forward voltage drops. The current through each LED is controlled by a reference current through a first digitally controlled variable resistance circuit, and directing the LED current through a second digitally controlled variable resistance circuit having substantially a known ratio to the first variable resistance circuit and connected in series with the LED. A digital count is altered based on a comparison of the first and second currents, and the first and second variable resistance circuits are simultaneously altered based on the digital count.

However, in some lighting applications, multiple LED's are driven together to achieve the requisite luminosity. In these lighting applications the LED's are activated and light up simultaneously. For example, U.S. Pat. No. 6,756,893 issued to Fernandez teaches a plurality of light emitting diodes that are mounted on a base that surrounds a primary vehicle light source such as a headlight. A control circuit senses when the primary light source fails to provide the requisite light, and applies power to the light emitting diodes so that the vehicle can continue safely without loss of the function served by the primary light source. LEDs are also used in applications such as garden lights or outdoor lights typically used in residential applications to light walkways or to provide decorative illumination in yards or gardens, as taught in US Patent Application Publication No. 2007/0091598 by Chen which discloses low voltage garden lights incorporating LEDs.

Another such example of LED applications is U.S. Pat. No. 5,896,084 issued to Weiss et al., which teaches a tail light assembly for a motor where at least one of the rear lights, the brake light and the turn signal light is comprised of LEDs and has a control device for operating the LEDs at a constant current for a given voltage range.

In addition, U.S. Pat. No. 7,685,753 issued to Slowski teaches an illuminated, shallow weatherproof signage character that has individual three dimensional back-lighted/front/side and/or silhouette-lighting, with miniature, LED lamps concealed in the character.

Other refinements to LED driver circuits include addition of dimming capability, improvements in current control, and design simplification. US Patent Application Publication No. US 2010/0295478 A1 to Wei et al. teaches an LED driving circuit adapted to couple with a power supply and phase control dimmer to provide stable dimming performance. Also, US Patent Application Publication No. US 2011/0140622 A1 to Suzuki describes an LED driving circuit that uses a phase-controlled dimming circuit for constant current drive with a bleeder circuit included. U.S. Pat. No. 7,977,891 to Shiu et al. teaches an LED driving circuit comprising a transistor switch and a feedback controller. The invention uses voltage sensing feedback for current control. US Patent Application Publication No. US 2009/0315480 A1 to Yan et al. is a brightness-adjustable LED driving circuit with power factor correction. US Patent Application Publication No. US2010/0072898 A1 to Ohashi et al. teaches an LED driving circuit with serially connected LEDs using a switching device to control current flow, and another patent, U.S. Pat. No. 7,138,770 to Uang et al. is an LED driving circuit that is directly activated by an AC power supply. The LEDs are directly driven by placement within the bridge rectifier circuit.

The above mentioned patents and applications teach regulation of LED drive current of an LED string but do not teach reconfiguring the LED string for control of drive current.

Most LEDs are current devices and operate at specific current levels that are functions of the supply voltage. The current increases rather quickly as the voltage increases beyond the optimum level. Conventional LED driver circuits are essentially power supply units that regulate either the output voltage or the current. They do not make use of the fact that many LEDs are typically strung together to have a reasonable voltage drop across the string.

There is a need for a more energy efficient LED driving method for such lighting. The methods and systems of the present invention provide the foregoing and other advantages.

SUMMARY OF THE INVENTION

The present invention relates to a system and method for driving Light Emitting Diodes (LEDs) where the input voltage is variable. The variable input LED driving system and method includes a controller for sensing input voltage and adaptively configuring the connection of the LEDs to a voltage source using a series of switches. The controller can include digital or analog circuits or a combination of digital and analog circuits. The controller determines the switch settings on a circuit connected to a plurality of LEDs. Alternatively, the controller may sense the voltage across or the current through the LEDs to determine the switch settings. As voltage increases across the LEDs or in the input, the controller progressively lights up more LEDs.

In another embodiment of the system and method for driving LEDs wherein the input is variable, the controller can close any combination of switches to bypass the corresponding LEDs to match the requisite voltage and current.

The disclosed reconfigurable LED system includes a plurality of electrically connected LEDs. Each LED has an electrical connection exhibiting a first polarity, e.g. positive, and an electrical connection with a second polarity, e.g. negative; or vice versa. A power source with a first polarity, e.g. positive, and a second polarity, e.g. negative, is also attached that can be AC, rectified AC, or DC. The rectified AC power source can include at least one waveform filter. At least one switch is connected between the first polarity of the power source and the first polarity of at least one of the electrically connected LEDs. The system also uses a controller for monitoring at least one of voltage and current supplied to the plurality of electrically connected LEDs and for controlling switching so that the reconfigurable LED system can accommodate voltage variations in the power source. Any of the LEDs can be forward biased or reverse biased. A reverse biased LED can act as a photodiode. The reconfigurable LED system can use pulse width modulation switches that may be solid state or mechanical switches.

The reconfigurable LED system further includes an optional current regulator configured in series with the plurality of LEDs for controlling current passing through the plurality of LEDs. The reconfigurable LED system further may include a current sensing resistor configured in series with the plurality of LEDs for monitoring and controlling current passing through the plurality of LEDs.

A method of driving a plurality of LEDs is also disclosed. The steps include detecting voltage, configuring an initial selection of a plurality of LEDs based on a predetermined voltage and current setting, detecting a change in voltage, and configuring a subsequent selection of a plurality of LEDs in response to the change in voltage, and continued monitoring for occurrence of a subsequent change in voltage and reconfiguring the plurality of LEDs, such that the configuring of LEDs accommodates voltage variations in a power source.

The detecting step above can include the additional step of receiving a voltage reading from a voltage sensing circuit capable of communicating the voltage reading to a reconfigurable LED system controller. Furthermore, the configuring step can include the substeps of calculating the number of connected LED's drivable by the voltage, determining the switch configuration associated with driving the number of connected LEDs, and implementing the switch configuration. The calculating step can include the additional steps of retrieving voltage and current characteristics for the number of connected LEDs, determining at least one voltage value associated with a specified current to drive the plurality of LEDs, and applying at least one voltage value to determine an LED configuration.

An alternative embodiment of a method is disclosed for driving a plurality of LEDs. The steps include detecting voltage; configuring an initial selection of a plurality of LEDs based on a predetermined voltage and current setting, detecting a change in current, configuring a subsequent selection of a plurality of LEDs in response to the change in current, and continued monitoring for changes in current and repeating the reconfiguration in response to such change, such that the configuring accommodates voltage variations in a power source.

The detecting step includes receiving a voltage and current reading from a sensing circuit capable of communicating the voltage and current reading to a reconfigurable LED system controller.

The configuring step includes calculating the number of connected LED's drivable by the power source, determining a switch configuration associated with driving the number of connected LEDs, and implementing the switch configuration.

The calculating step includes retrieving voltage and current characteristics for the number of connected LEDs, determining at least one current value associated with a specified voltage to drive the plurality of LEDs, and applying at least one current value to determine an LED configuration.

BRIEF DESCRIPTION OF THE DRAWINGS

The present invention will hereinafter be described in conjunction with the appended drawing figures, wherein like reference numerals denote like elements, and:

FIG. 3B shows a simulated trace of AC input waveform supplied to an example embodiment of the reconfigurable LED string.

FIG. 3C shows a simulated trace of full-wave rectified AC input waveform supplied to an example embodiment of the reconfigurable LED string.

FIG. 3D shows a simulated trace of filtered full-wave rectified AC input waveform supplied to an example embodiment of the reconfigurable LED string.

DETAILED DESCRIPTION

The ensuing detailed description provides example embodiments only, and is not intended to limit the scope, applicability, or configuration of the invention. Rather, the detailed description of the example embodiments will provide those skilled in the art with an enabling description for implementing an embodiment of the invention. It should be understood that various changes may be made in the function and arrangement of elements without departing from the spirit and scope of the invention as set forth in the appended claims.

The present invention describes a system and method of adaptively configuring LEDs as supply voltage varies or fluctuates. For example, the present invention may be used in connection with certain lighting applications such as house lights, where multiple LEDs in a bulb are driven together to achieve a desired brightness.

Figure 1:
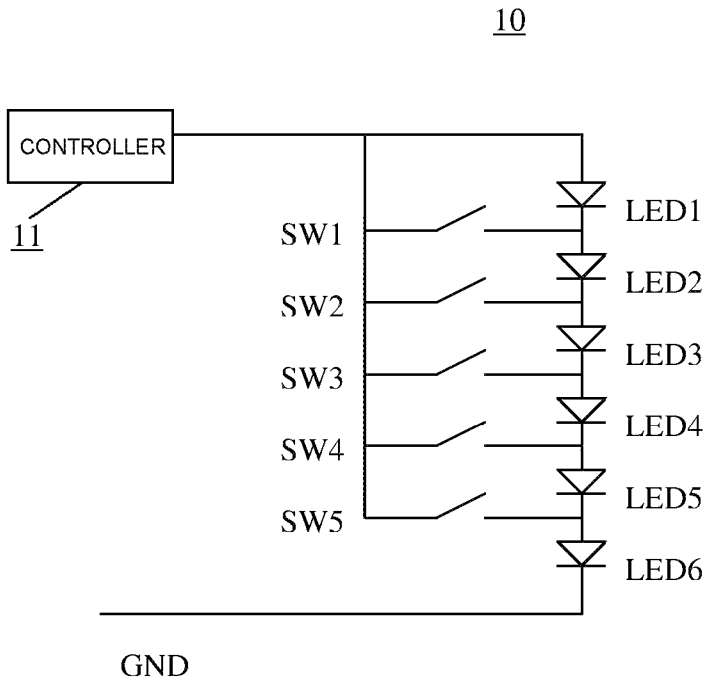
FIG. 1 shows a functional block diagram as an example embodiment of the system and method for driving LEDs wherein the voltage is variable.

Referring now to FIG. 1, a functional block diagram is shown as an example embodiment of the system and method for driving LEDs where the input voltage is variable. A power supply with a current control circuit and a string of LED's with switches is generally indicated by numeral 10. Controller 11 supplies power to the circuit 10 and is connected in series with LED1-LED6. Switches SW1-SW5 correspond with LED1-LED6. The controller adaptively configures the wiring of the LEDs using the switches. The switches can be metal oxide semiconductor field effect transistors (MOSFETs) that can turn on and off in microseconds. The controller 11 may sense the AC input voltage (or rectified AC voltage) to determine the switch settings. For example, the controller 11 may detect the magnitude of the input voltage and output a signal for each of the switches SW1-SW5 to regulate their state as on or off. Alternatively, the controller 11 may sense the voltage across or current through LED1-LED6 to determine the switch settings. For example, when a garden light transformer is used to output 12V RMS, the fluctuation in voltage may be +/−17V from peak to peak. The nominal forward voltage drop across LED1-LED6 is 3V. If the AC input voltage is nominally 3V, controller 11 closes switch SW5 and LED6 will light up. If the controller detects AC input voltage as nominally 6V, controller 11 closes switch SW4 and LED5 and LED6 will light up (note that in this instance, switch SW5 must be open). The controller 11 progressively lights up more LEDs as the voltage increases. The controller 11 may also sense the current through the LEDs to determine which switch to activate. Further, the switches SW1-SW5 can be configured not to exceed a predetermined maximum current through the LEDs. The controller 11 may also consider other factors when determining the switch SW1-SW5 settings such as the temperature of the LEDs and/or the maintenance of a predetermined brightness level of a group of LEDs.

In the example embodiment of FIG. 1, a sufficient number of LEDs can be biased such that current flow through the individual LEDs of the string are maintained close to optimum operating conditions for the devices at the input voltage introduced. In the present invention, a constant current can generally be maintained as input voltage varies or the current can vary proportional to the input voltage to mimic a resistive load. An approximation of a resistive load would give a very high power factor, close to 1, which is preferred by utility companies as it optimizes efficiency.

Figure 2A:
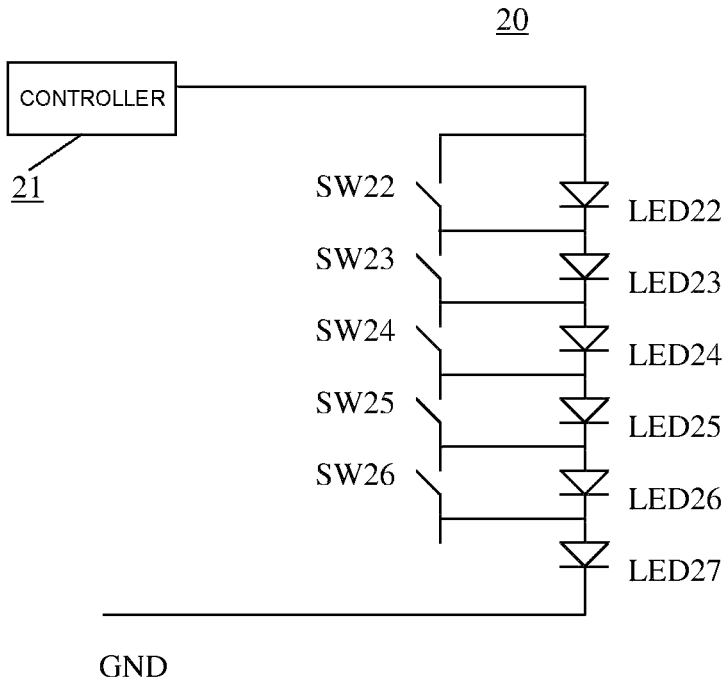
FIG. 2A shows a functional block diagram as another example embodiment of the system and method for driving LEDs wherein the voltage is variable.

Referring now to FIG. 2A, a functional block diagram of another example embodiment of the inventive system and methods is provided where the input is variable. A power supply with a current control circuit and a string of LED's with switches is indicated by numeral 20. Controller 21 supplies power to the circuit 20 and is connected in series with LED22-LED27. Switches SW22-SW26 correspond with LED22-LED27. The controller 21 senses the AC input voltage (or rectified AC voltage) to determine the switch settings. Alternatively, the controller 21 may sense the voltage across or current through LED22-LED27 to determine the switch settings. The controller 21 can close any combination of switches SW22-SW26 to bypass the corresponding LED22-LED27 to match the requisite voltage and current.

Figure 2B:
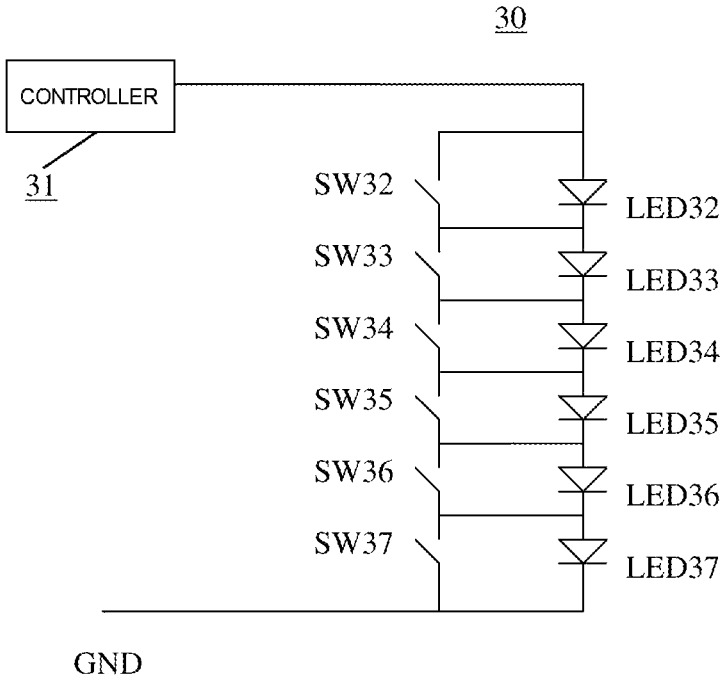
FIG. 2B shows a functional block diagram of an example embodiment for the system and method for driving LEDs with an optional switch.

FIG. 2B is a functional block diagram of another example embodiment of the system and method for driving LEDs where the input is variable. A power supply with a current control circuit and a string of LED's with switches is indicated by numeral 30. Controller 31 supplies power to the circuit 30 and is connected in series with LED32-LED37. Switches SW32-SW37 correspond with LED32-LED37. Switch 37 is optional.

Figure 3A:
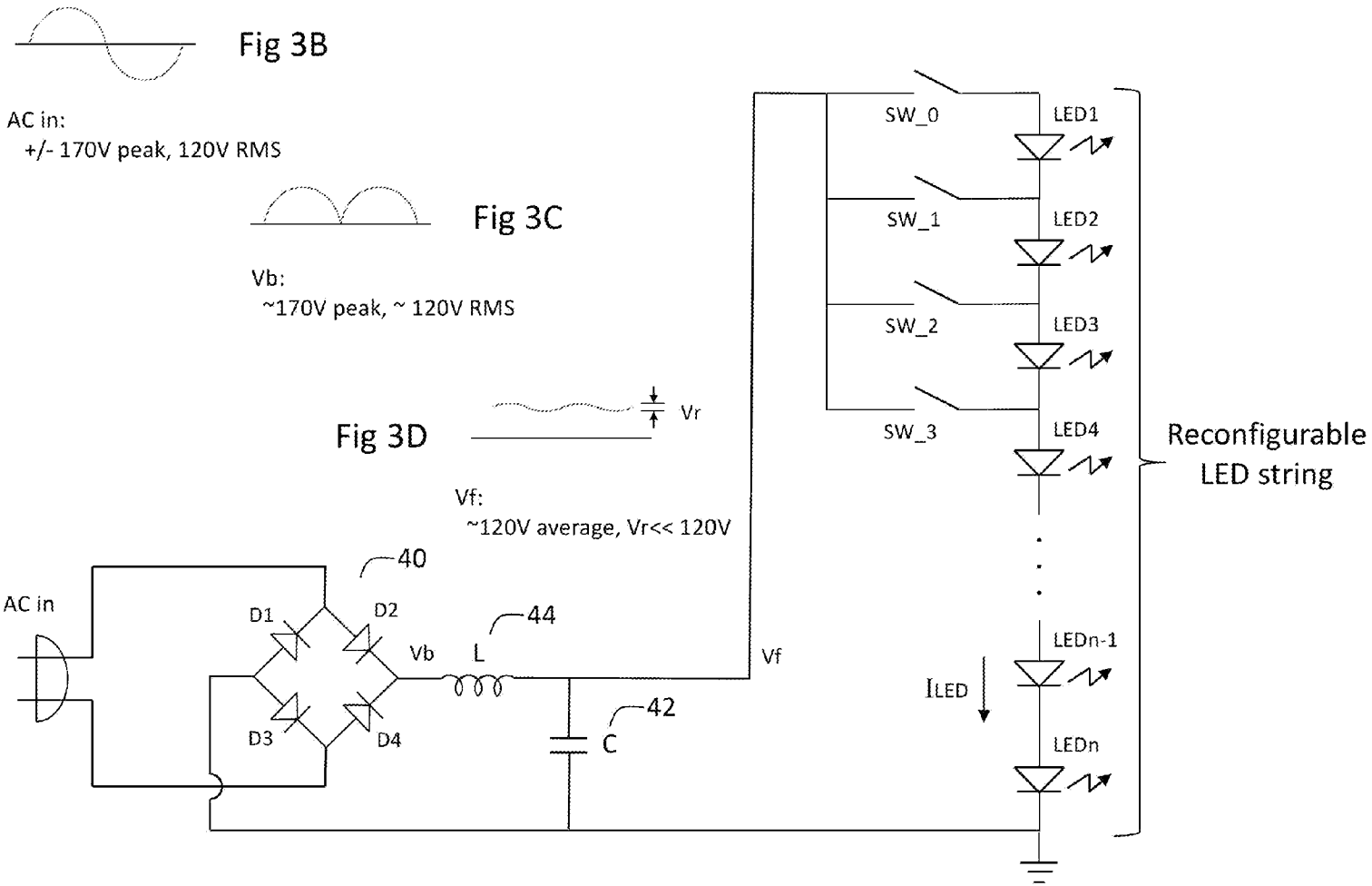
FIG. 3A shows a circuit diagram of an example embodiment of the reconfigurable LED string.
Figure 4:
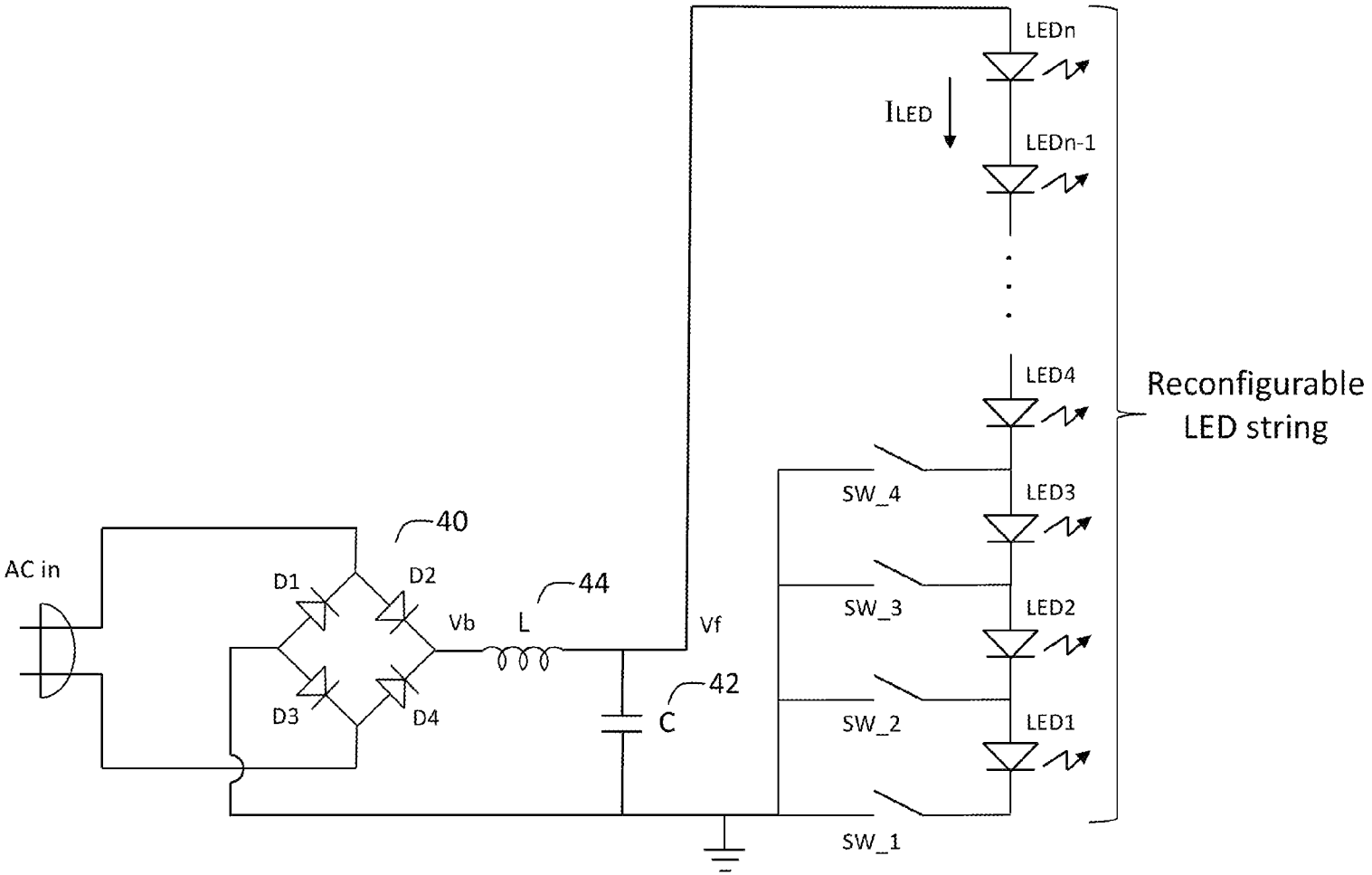
FIG. 4 shows a circuit diagram of an alternative example embodiment of the reconfigurable LED string.
Figure 5:
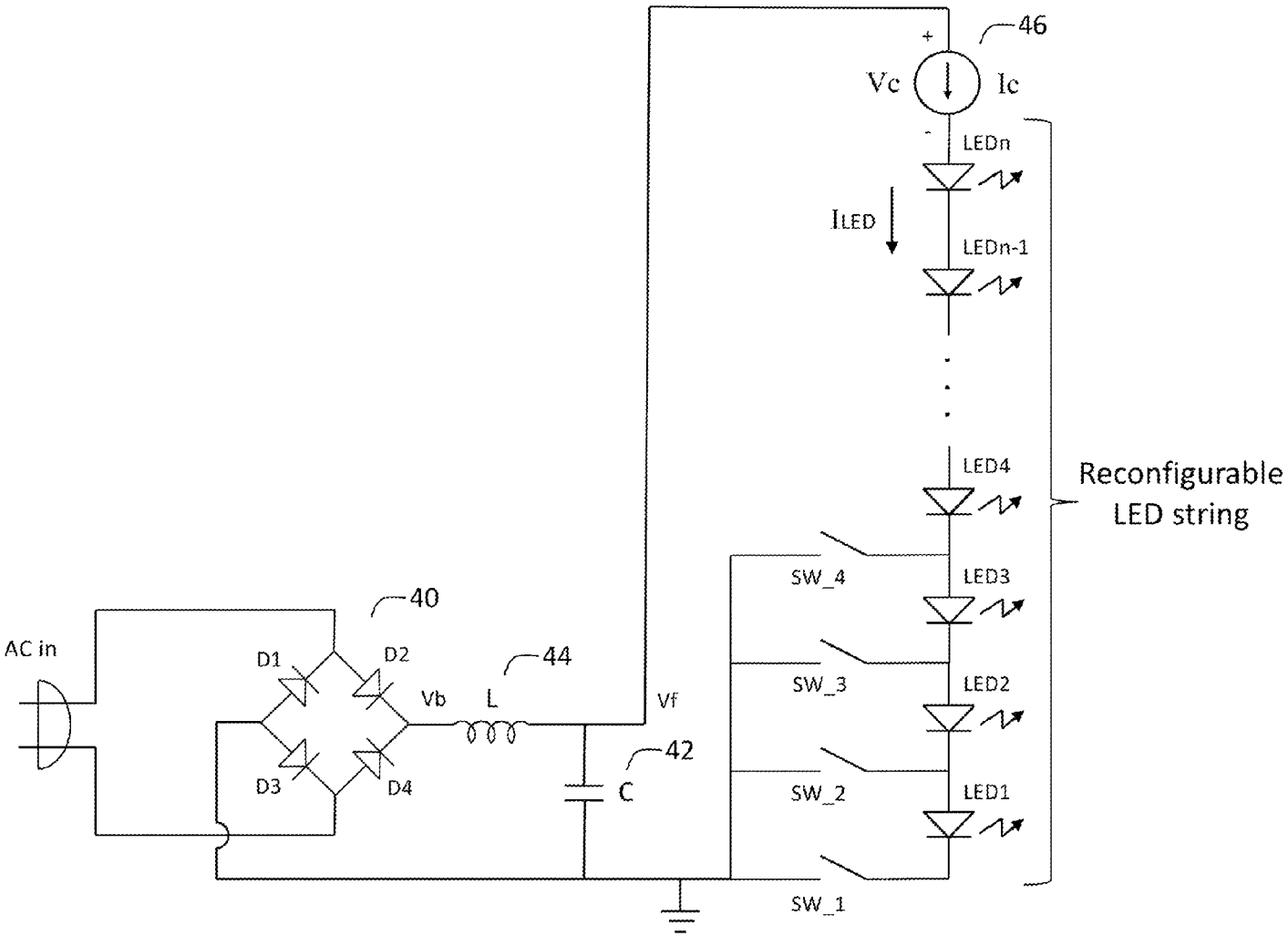
FIG. 5 shows a circuit diagram of an alternative example embodiment of the reconfigurable LED string with addition of a current regulator element.

In instances where the input voltage to the controller is AC, with both positive and negative polarities, a rectifier (e.g., a full wave rectifier) may be added to change the AC voltage to a single polarity, such as positive only. The addition of a full wave rectifier to the power line supplying the circuit allows the LEDs to be on longer (i.e., twice as long) than without a full wave rectifier. FIGS. 3A, 4, and 5 show such a configuration. In particular, a full wave bridge rectifier 40 is shown followed by a waveform filtering capacitor 42 and inductor 44 after the full wave rectifier 40 to reduce the waveform ripple caused by the rectifier circuit. The embodiments described above, however, do not require a large capacitor, as the circuits can be configured to adapt to the voltage fluctuation caused by the full wave rectifier 40. The AC input signal to the rectifier circuit 40, as well as the rectified voltage before and after waveform filtering is shown in FIGS. 3B-3D. In FIG. 3B, AC voltage input is shown as a sinusoidal signal with +/−170V peak, and 120V RMS voltage. FIG. 3C shows a full wave rectification of the signal after passing through the bridge rectifier. Vb, the voltage output from the bridge rectifier is about 170V peak, 120V RMS. FIG. 3D shows a resulting DC voltage, Vf, following waveform filtering. A small ripple voltage, Vr, remains, but can be minimized by effective filter design. Here, the filtered voltage, Vf, for the LED string is shown to be about 120V average, with a Vr of significantly less than that value. It should be noted that the invention supports alternate ways of rectifying AC voltage. One example is the use of a synchronous rectifier that uses MOSFET transistors and does not incur diode voltage loss.

FIG. 3A also shows an example LED driver circuit, where a subset of LEDs (designated LED1-LED4) in a reconfigurable LED string (designated LED1-LEDn) can be selectively biased by reconfiguring switches (designated SW_0 through SW_3) attached to the subset of LEDs. When an LED is emitting light, it is using a specified amount of voltage that is greater than the turn-on voltage and is supplied from a power source. This specified voltage may be less than the supply voltage. The present invention reconfigures the string of series connected LED's such that a sufficient number of LED's are electrically connected so that the electrical load, equal to the sum of the voltage drop across all the series connected LEDs, is about equal to Vf. This is accomplished while maintaining current through the string of LED's (designated ILED) at a value that results in optimum LED performance. While LED brightness increases with increasing ILED, excessive LED current shortens device life and affects performance. A controller, not shown, monitors the supplied voltage Vf and dynamically configures the LED switches (designated SW_0 through SW_3) as needed to connect sufficient LEDs in series to handle the instantaneous supply voltage, Vf, without encountering excessive LED current, ILED. If a small change in voltage is expected, only a small subset of LEDs need be connected to switches to selectively include (or bypass) any LEDs to subtract (add) a sufficient voltage drop to compensate for a voltage shift. Incremental voltage can be obtained, e.g., by Pulse Width Modulation (PWM) switching.

The steps for configuring the string of reconfigurable LEDs include detecting voltage, which includes the additional step of receiving a voltage reading from a voltage sensing circuit capable of communicating the voltage reading to a reconfigurable LED controller (not shown in FIGS. 3A, 4, and 5). After detecting voltage, an initial selection of a plurality of LEDs is configured based on a predetermined voltage and current setting. This configuring step includes the substeps of calculating the number of connected LED's drivable by the voltage, determining the switch configuration associated with driving the number of connected LEDs, and implementing the switch configuration. The calculating step includes the additional steps of retrieving voltage and current characteristics for the connected LEDs. This step is followed by determining drive voltage (or current) values for the string of LEDs at the desired drive current (or voltage), and applying those voltage (or current) values in the calculation to determine an optimum LED string configuration.

A continued monitoring by the controller detects any changes in voltage (or current), and a subsequent selection of a plurality of LEDs is configured in response to the change in voltage (or current) such that the subsequent configuration of LEDs accommodates voltage variations in a power source. The subsequent selection of LEDs may include LEDs that were also configured in the previous selection of LEDs. The circuit continues to be monitored for changes in voltage (or current) and responds to such changes by reconfiguring the LED string accordingly.

Several circuit embodiments are capable of performing the present invention. FIG. 3A shows an embodiment of an LED driver circuit where the switches connect from the positive side of the supply voltage. FIG. 4 shows another embodiment of an LED driver circuit where the switches (designated SW_1 through SW_4), connect to the ground side of the DC supply voltage. Operation of the embodiments of FIGS. 3A and 4 perform similarly.

FIG. 5 shows another embodiment of an LED driver circuit that incorporates a current regulator 46 (designated Ic). One example current regulator is a fixed resistor. It is called a current limiting resistor that is placed in series with the LED, and functions to drop the excess voltage. Such a resistor is not as precise as a constant current source, but cheap and used by many inexpensive LED light bulbs. In the present invention, the unwanted voltage drop is no larger than a forward voltage drop of one LED, even if the input voltage fluctuates a lot. As a result, a small current limiting resistor can be used without creating too much wasted heat. The controller reconfigures the LED switches so as to minimize the voltage drop Vc across the current regulator. By minimizing Vc, only minimum power need be diverted to the current regulator from the power supplying the reconfigurable LED string, allowing most of the energy to be used to drive the LED string.

Figure 6A:
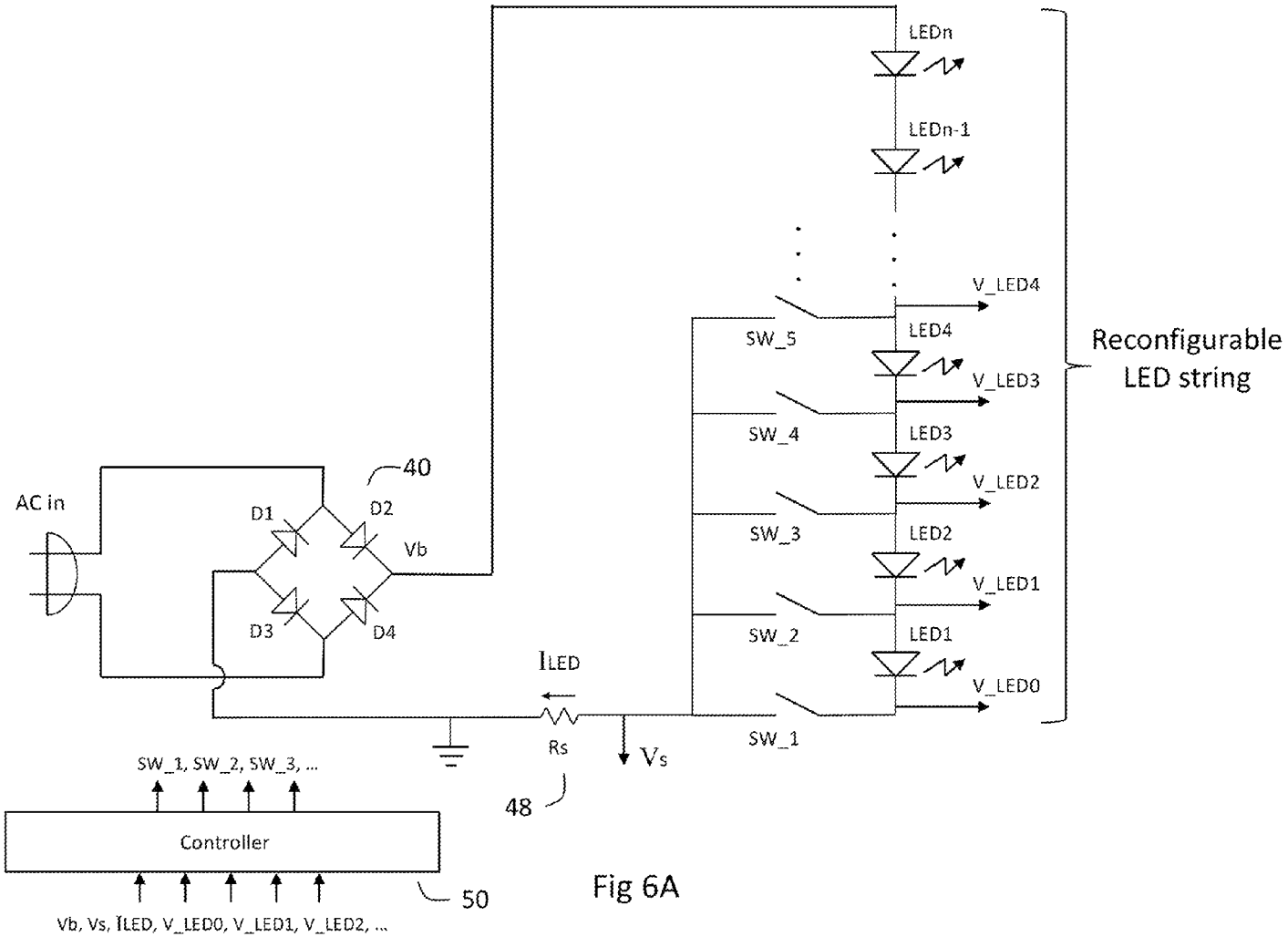
FIG. 6A shows a circuit diagram of an alternative example embodiment of the reconfigurable LED string with addition of a current sensing resistor.

FIG. 6A shows another embodiment of an LED driver circuit that incorporates a current sensing resistor 48 (designated Rs). In the illustrated representation of the embodiment, no inductive and capacitive filtering is used, thereby reducing system cost and increasing system reliability. Waveform filtering, however, may optionally be included. The current sensing resistor 48 functions to monitor current through the circuit (designated ILED) and voltage Vs and ILED are sent to the controller 50 for monitoring. The controller 50 can be implemented as a microcontroller, a combination of digital and analog circuits, or all analog circuits. The value of the current sensing resistor 48 can be made small to minimize resistive power loss. Individual LED voltages (designated V_LED0 to V_LEDn) are also monitored by the controller 50. Switches SW_1 through SW_5 respond to signals from the controller 50 to open or close as needed to configure the string of LEDs to turn on or off, thereby regulating current flow through the circuit. Further, the controller 50 monitors Vb and if the controller 50 senses Vb to be too large for the LED string and current sensing resistor to handle, all switches, SW_1 through SW_n (where 'n' is the number of switches in the reconfigurable LED string), can be controlled to be in an open state to prevent circuit damage.

Figure 6B:
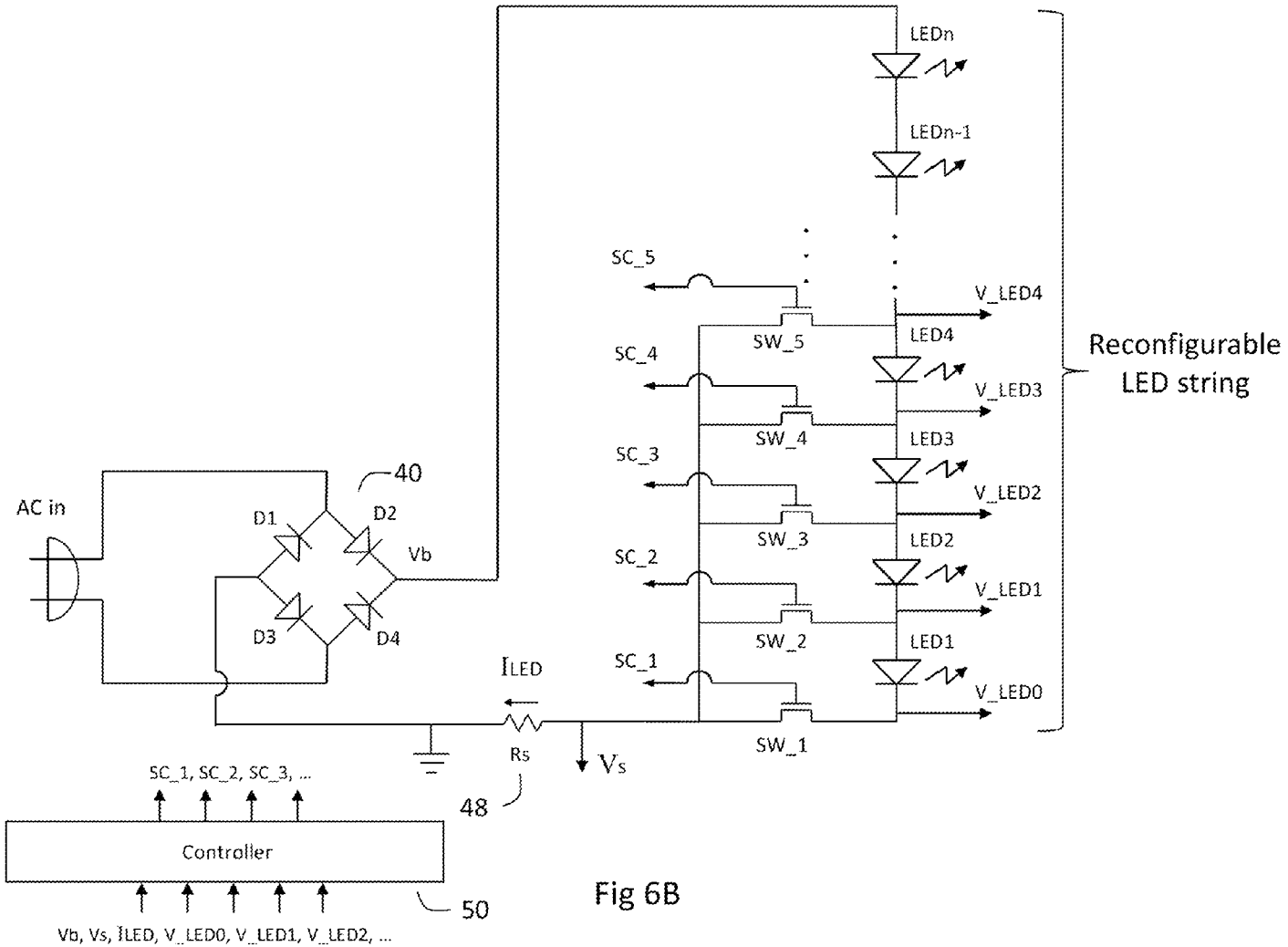
FIG. 6B shows a circuit diagram of an alternative example embodiment of the reconfigurable LED string with addition of a current sensing resistor and transistor switches.

FIG. 6B shows another embodiment of an LED driver circuit that incorporates a current sensing resistor 48 (designated Rs) and switches SW_1 through SW_5 are MOSFET transistor switches. In FIG. 6B, five (5) transistor switches (designated SW_1 through SW_5) are shown, each connected to a control signal line (designated SC_1 through SC_5). The switch controller 50 sends a control signal through SC_x (where 'x' corresponds to the switch number) to turn switch SW_x on or off, or to modulate the switch to perform Pulse Width Modulation, PWM. Alternatively, SC_x can be an analog signal controlling the current flow. Furthermore, the current sensing resistor in FIG. 6B can double duty as a current limiting resistor if desired. Also, LED's typically can tolerate 100 to 200% over current for a brief period of time. If duty cycle modulation or PWM is used (adding or subtracting one LED out of a string of many LED's), the loss through a current limiting resistor can be entirely avoided. Limiting the excess current to a small value is helpful for extending LED life.

The number of LEDs without a switch attached is a matter of cost control versus efficiency. FIG. 3 through FIG. 5 show three (3) LEDs connected though switches, while FIGS. 6A and 6B show five (5) LEDs in the string connected through switches.

Furthermore, each LED drawn in FIGS. 1 through 6 can represent multiples LEDs connected in series (i.e., Banks of LEDs), thereby reducing the number of switches used in the design.

In addition, a master switch can be included in the example embodiments shown in the Figures. For example, the master switch can be added at the input AC voltage, to turn the circuit completely on or off. The functionality of turning the LEDs on or off would be useful in an application such as a light bulb that includes the LEDs.

Another switch may be added in series with the supply input to the circuits shown in the Figures. The additional switch controls the duty cycle of the current flowing through all the LED's, which would provide more precise control of the brightness of the lamp. A more precise control of the lamp can be useful when the on-off voltage increment is too coarse. Alternatively, instead of the series switch, one or more of the switches may be modulated to achieve a desired "average" current, which would provide a finer control of the overall brightness. Again, it overcomes the granularity of completely turning on or off each LED at the increment of 3V (some LED's may be rated at a different voltage drop).

Moreover, the controllers described in FIGS. 1-6B can function as light dimmers. For example, a controller would receive user input indicating a dimmer level as an analog or digital value. A predetermined combination of on or off switches would modulate the current through the LEDs and modulate the duration of the current, e.g. pulse width modulation, or the number of LEDs to be switched on.

Further, the controllers may include capability for remote communication enabling a device, such as a light bulb including the circuits (described in FIGS. 1-2B) to be controlled remotely. Remote communication to the controllers may occur through a power line communication scheme, such as the well known X10 home automation standard, for example. Each light bulb would be assigned a unique address and AC-IN would carry the communication signal obviating the need for additional wiring to the light bulb other than the wiring carrying power. All the light bulbs in a house or car for example, can be bussed together without a dedicated switch to each light bulb. The light bulbs may be controlled on and off through a smart switch that communicates with the light bulbs through a power line. X10 is an international and open industry standard for communication among electronic devices used for home automation. Power line wiring is used for signaling and control, where the signals involve brief radio frequency bursts representing digital information. A wireless radio based transport protocol is also defined.

In addition, the controllers can enable each light bulb to coordinate with other light bulbs in the same circuit. One example would be to "offset" the on or off times to improve the overall power factor. For example, if all the light bulbs go on and off at the same time, say for dimming, the power factor will be low.

Moreover, the controllers may enable light bulbs to detect motion (as in motion activated lights) or presence of a person. For example, two light bulbs may coordinate. One light bulb may flash briefly and the other light bulb that is located at a distance away from the first one detects the amount of light that reflects off surfaces. If the light level changes over a specific period of time in a consistent manner, motion detection is triggered. This can be coordinated between the light bulbs, either through the power line or through a light detection mode (LED itself or a dedicated photo detector diode). A single light bulb may also detect motion, for example when a light bulb includes many LEDs, one of the LEDs that is off can act as a photo detector.

Furthermore, the controllers may detect a faulty LED and reconfigure around it to maintain the operation of a light bulb that includes multiple LEDs. For example, redundant LED's can be placed so that one or two failures do not take the light bulb out of service. The faulty status can be communicated through a power line communication scheme for ease of maintenance.

Moreover, the input voltage to the controllers may be DC. For example, an automobile typically uses 12V DC. The voltage fluctuation is less than occurs with household AC. However, fluctuation below 12V can occur (e.g., when an engine is cranked) to above 14 to 15V (e.g., when the alternator is running to recharge the battery). In this example, the number of switches for the LEDs may be reduced while power line communication is still used.

In addition, LEDs may be configured to act as photodiodes allowing transmission and reception of light signals. A controller can modulate the light output of the LEDs to communicate with a remote controller or other LED light bulbs, for example. The controller could also send status signals regarding the condition of the light bulbs. For example, the controller could sense whether one or more of the light bulbs are burned out and send a status signal indicating such.

To maximize power utilization efficiency, resistive losses should be minimized. A current limiting resistor will dissipate power as resistive loss. A linear current regulator would essentially have a variable resistor (e.g. power MOSFET transistor) having the same loss (proportional to the voltage drop needed to maintain a desired current level). A switching regulator would be more efficient (80 to 90%) but can be expensive and bulky.

The reconfigurable LED system and method of the present invention can be much more efficient, merely requiring the expense of extra LED's to use sufficient energy in the event of a worst case input voltage change. Input voltage can be filtered to reduce the peak voltage and to reduce voltage variations, that helps to reduce the number of LED's and number of switches. There is a trade-off between filtering inductors or capacitors (large capacitors are more prone to long term failure) and number of transistor switches.

Alternative embodiments may include more than one circuit module, where each module is configured as shown in FIG. 6A or 6B for example. The modules may be connected in series or in parallel. Each circuit module would reconfigure the connected LEDs somewhat independent of another circuit module, although coordination and control signals may be exchanged between the circuit modules.

It should now be appreciated that the present invention provides advantageous methods and systems for driving LEDs wherein the input voltage is variable.

Although the invention has been described in connection with various illustrated embodiments, numerous modifications and adaptations may be made thereto without departing from the spirit and scope of the invention as set forth in the claims.

What is claimed is:

1. A reconfigurable LED system comprising:

a plurality of LEDs electrically connected in series, each of the LEDs having an electrical connection with a first polarity and an electrical connection with a second polarity;

a power source with a first polarity and a second polarity;

a respective switch connected between said second polarity of said power source and said second polarity of each of said LEDs; and a controller for continuously monitoring at least one of voltage and current supplied to said plurality of LEDs and for selectively controlling switching of said respective switches in response to the at least one of voltage and current supplied;

an inductor between said first polarity of said power source and said first polarity of a first of the series connected LEDs;

wherein said reconfigurable LED system accommodates voltage variations in said power source by modulating at least one of the switches so as to maintain a desired average current through the plurality of LEDs connected to the power source.

2. The reconfigurable LED system according to claim 1, wherein said electrical connection with a first polarity is a positive polarity and said electrical connection with a second polarity is a negative polarity.

3. The reconfigurable LED system according to claim 1, wherein said power source comprises one of AC, rectified AC, or DC.

4. The reconfigurable LED system according to claim 3, wherein said rectified AC power source includes at least one waveform filter.

5. The reconfigurable LED system according to claim 1, wherein at least one of said plurality of LEDs is forward biased.

6. The reconfigurable LED system according to claim 1, wherein at least one of said plurality of LEDs is reverse biased.

7. The reconfigurable LED system according to claim 6, wherein said at least one of said plurality of LEDs is reverse biased to act as a photodiode.

8. The reconfigurable LED system according to claim 1, wherein said at least one switch comprises pulse width modulation switches.

9. The reconfigurable LED system according to claim 1, wherein said at least one switch comprises at least one of solid state and mechanical switches.

10. The reconfigurable LED system according to claim 1 further comprising a current regulator configured in series with said plurality of LEDs for controlling current passing through said plurality of LEDs.

11. The reconfigurable LED system according to claim 1 further comprising a current sensing resistor configured in series with said plurality of LEDs for monitoring and controlling current passing through said plurality of LEDs.

12. The reconfigurable LED system according to claim 1, wherein said controller comprises digital or analog circuits or a combination of digital and analog circuits.

13. A method of driving a plurality of LEDs comprising:

a) detecting voltage;

b) configuring an initial selection of a plurality of LEDs based on the detected voltage and a predetermined current setting;

c) detecting a change in voltage;

d) configuring a subsequent selection of a plurality of LEDs in response to said change in voltage; and e) repeating steps c) through d);

wherein said configuring accommodates voltage variations in a power source.

14. A method in accordance with claim 13, wherein said detecting comprises receiving a voltage reading from a voltage sensing circuit capable of communicating said voltage reading to a reconfigurable LED system controller.

15. A method in accordance with claim 14, wherein said configuring comprises:

calculating the number of connected LED's drivable by said voltage;

determining a switch configuration associated with driving said number of connected LEDs; and implementing said switch configuration.

16. A method in accordance with claim 15, wherein said calculating comprises:

retrieving voltage and current characteristics for said number of connected LEDs;

determining at least one voltage value associated with a specified current to drive said plurality of LEDs; and applying said at least one voltage value to determine an LED configuration.

17. A method of driving a plurality of LEDs comprising:

a) detecting voltage;

b) configuring an initial selection of a plurality of LEDs based on the detected voltage and a predetermined current setting;

c) detecting a change in current;

d) configuring a subsequent selection of a plurality of LEDs in response to said change in current; and e) repeating steps c) through d);

wherein said configuring accommodates voltage variations in a power source.

18. A method in accordance with claim 17, wherein said detecting comprises receiving a voltage and current reading from a sensing circuit capable of communicating said voltage and current reading to a reconfigurable LED system controller.

19. A method in accordance with claim 17, wherein said configuring comprises:

calculating the number of connected LED's drivable by said power source;

determining a switch configuration associated with driving said number of connected LEDs; and implementing said switch configuration.

20. A method in accordance with claim 19, wherein said calculating comprises:

retrieving voltage and current characteristics for said number of connected LEDs;

determining at least one current value associated with a specified voltage to drive said plurality of LEDs; and applying said at least one current value to determine an LED configuration.

* * * * *

UNITED STATES PATENT AND TRADEMARK OFFICE

CERTIFICATE OF CORRECTION

PATENT NO. : 8,841,862 B2
APPLICATION NO. : 13/527787
DATED : September 23, 2014
INVENTOR(S) : Lee It is certified that error appears in the above-identified patent and that said Letters Patent is hereby corrected as shown below:

In the Claims:

Column 11, line 1: "15. A method in accordance with claim 14, wherein said" should read -- 15. A method in accordance with claim 13, wherein said --

Signed and Sealed this
Second Day of December, 2014

Michelle K. Lee

Michelle K. Lee
*Deputy Director of the United States Patent and Trademark Office*